US005921810A

United States Patent [19]

Murakoshi

[11] Patent Number: 5,921,810

[45] Date of Patent: Jul. 13, 1999

[54] SHORT-CIRCUIT TERMINAL ASSEMBLY

[75] Inventor: Hiroyuki Murakoshi, Shizuoka, Japan

[73] Assignee: Yazaki Corporation, Tokyo, Japan

[21] Appl. No.: 08/874,343

[22] Filed: Jun. 13, 1997

[30] Foreign Application Priority Data

Jun. 19, 1996 [JP] Japan ..... 8-158429

[51] Int. Cl.[6] ..... H01R 31/08

[52] U.S. Cl. ..... 439/510; 439/512

[58] Field of Search ..... 439/510, 512, 439/513, 507–509

[56] References Cited

U.S. PATENT DOCUMENTS

| | | | |
|---|---|---|---|
| 3,932,013 | 1/1976 | Yeager et al. | 439/510 |
| 4,883,430 | 11/1989 | Siemon et al. | 439/512 |
| 5,655,927 | 8/1997 | Manue et al. | 439/510 |

FOREIGN PATENT DOCUMENTS 6-310186 11/1994 Japan .

*Primary Examiner*—Hien Vu

*Attorney, Agent, or Firm*—Sughrue, Mion, Zinn, Macpeak & Seas, PLLC

[57] ABSTRACT

A short-circuit terminal assembly comprised of two components: a housing and a U-shaped short-circuit terminal. The housing includes a box portion having its one end surface substantially closed and its other end surface opened as an open portion, and further includes a terminal holding portion which projects from the substantially closed end surface toward the opposite end surface so as to halve the hollow inside of the box portion. The U-shaped short-circuit terminal includes a short-circuit bridge portion substantially bent into a U-shape in vertical section, and two pairs of elastic socket portions formed on outsides of opposite leg portions of the bridge portion by curving a pair of projection pieces toward each other on opposite sides of each of the leg portions so as to be formed into each pair of the elastic socket portions. Accordingly, the number of parts of the short-circuit terminal assembly as a whole is reduced so that not only reduction in cost can be attained but also assembling can be performed rapidly.

9 Claims, 4 Drawing Sheets

SHORT-CIRCUIT TERMINAL ASSEMBLY

BACKGROUND OF THE INVENTION

The present invention relates to a short-circuit terminal assembly which serves as a bridge between circuits such as bus bar circuits.

When an intermediate current fuse, which is fitted between predetermined terminals of a connecting portion constituted by connection terminals projecting into a box in an electric circuit in the inside of a vehicle or the like, becomes useless with the change of the type of the vehicle, conventionally, the electric circuit in the inside of the vehicle is changed by re-fitting of a short-circuit terminal assembly prepared in advance as a substitute for the intermediate current fuse, for example, as disclosed in Japanese Patent Unexamined Publication No. Hei 6-310186.

FIGS. 5 and 6 show a conventional example of the change of the electric circuit in the inside of a vehicle. FIG. 5 is a partly cutaway perspective view showing respective parts, and FIG. 6 is a sectional view of the short-circuit terminal assembly used in FIG. 5.

A connecting portion 3 is formed in a manner so that respective tabs 11 and 12 of first and second bus bars 1 and 2 buried in an electrically insulating substrate are bent so as to project into a box. An intermediate current fuse 4 is fitted to the connecting portion 3 so that the respective tabs 11 and 12 are fitted into built-in female terminals (not shown) to thereby close the box.

On the other hand, when the intermediate current fuse 4 is to be removed and the respective tabs 11 and 12 are to be shorted in accordance with the change of the electric circuit in the inside of the vehicle with the change of the type of the vehicle per se, or the like, the following structure is used popularly as a short-circuit terminal assembly therefor.

That is, the conventional short-circuit terminal assembly is constituted by a generally-reverse-U-shaped short-circuit terminal 7 attached into an inner space defined by a box portion 5 and a cover portion 6 which are able to be fitted into the box of the connecting portion 3.

As is apparent from the more detailed view of FIG. 6, the box portion 5 has its opened upper end surface closed by the cover portion 6, and its lower end surface substantially closed except opening portions 13 which are formed so that the tabs 11 and 12 can be fitted thereinto respectively. The box portion 5 further has a terminal holding portion 14 which is provided so as to project from the center of the lower end surface toward the upper end surface.

Further, in the reverse-U-shaped short-circuit terminal 7, a plate-like short-circuit bridge portion 8 is substantially bent to have a reverse U shape in vertical section and a pair of projection pieces are formed on opposite sides of each of leg portions of the reverse-U-shaped short-circuit bridge portion 8. The pair of projection pieces are curved into respective elastic socket portions 9 respectively which faces each other on each leg portion of the short-circuit bridge portion 8. Further, portions of the leg portions of the reverse-U-shaped short-circuit bridge portion 8 are cut-out and erected inward so as to form lance portions 10 so that the lance portions 10 are capable of being fitted into lock recesses 19 of the terminal holding portion 14.

In the reverse-U-shaped short-circuit terminal 7, the reverse-U-shape bent inner surface of the-short-circuit bridge portion 8 inserted into the box portion 5 from the upper end surface of the box portion 5 is fitted onto the terminal holding portion 14. Then, the upper end surface of the box portion 5 is closed by the cover portion 6 so as to make preparation for the change of the electric circuit in the inside of the vehicle. There has been proposed another reverse-U-shaped short-circuit terminal 7*a* of the type in which the plate-like short-circuit bridge portion 8 is replaced by an electric wire short-circuit bridge portion 8*a* and elastic socket portions 9*a*.

In view of compatibility with the intermediate current fuse 4 in which stability in the attachment state in the inside of the fuse member is attained in a manner so that the fuse bridge portion is bent into a reverse U-shape, the aforementioned conventional short-circuit terminal assembly is designed so that the plate-like short-circuit bridge portion 8 of the reverse-U-shaped short-circuit terminal 7 is also bent into a reverse U-shape in the same manner as the fuse bridge portion and fitted into the box portion 5.

The conventional assembly employs such a structure that it is roughly divided into the box portion 5, the cover portion 6 and the reverse-U-shaped short-circuit terminal 7 taking into account the compatibility with the intermediate current fuse 4. Accordingly, the number of parts thereof is large for the function imposed thereon to make the structure complicated.

Furthermore, the conventional short-circuit terminal assembly has a possibility that, when the two end portions of the reverse-U-shaped plate-like short-circuit bridge portion 8 are bent outward (in the direction of separation from the terminal holding portion 14) by external force, the elastic socket portions 9 are displaced in the same direction as mentioned above so as to discord from the tabs 11 and 12 passing through the opening portions 13 respectively so that a required circuit can not be closed.

SUMMARY OF THE INVENTION

An object of the present invention is to provide a short-circuit terminal assembly in which the problems in the aforementioned conventional short-circuit terminal assembly are solved and which has a structure inexpensive and easy to handle.

In order to achieve the above object, according to the present invention, there is provided a short-circuit terminal assembly comprising a housing and a U-shaped short-circuit terminal fitted into the inside of the housing, wherein: the housing includes a box portion having its one end surface substantially closed and its opposite end surface opened as an open portion, and further includes a terminal holding portion which projects from the substantially end surface toward the opposite end surface so as to halve the hollow inside of the box portion; the U-shaped short-circuit terminal includes a short-circuit bridge portion substantially bent into a U shape in vertical section, and two pairs of elastic socket portions formed on outsides of opposite leg portions of the bridge portion in a manner so that a pair of projection pieces formed on opposite sides of each of the leg portions are curved so as to be formed into each pair of the elastic socket portions facing each other; and the U-shaped short-circuit terminal is inserted into respective hollow inner portions of the housing from the open portion of the housing and fitted to the terminal holding portion.

In the above short-circuit terminal assembly, preferably, the terminal holding portion is made to include: lock projections provided on the terminal holding portion at its outer surfaces respectively near the one end surface so as to project for hanging and holding the short-circuit bridge portion; and an abutting end portion formed to have a shape substantially coincident with a U-shape bent inner bottom surface of the short-circuit bridge portion.

In the above short-circuit terminal assembly, preferably, the short-circuit bridge portion includes: lance portions formed in a manner so that respective end portions of leg portions of the short-circuit bridge portion near the one end surface are bent outward; engagement holes formed in the leg portions near the lance portions respectively so as to be engageable with lock projections on the outer surfaces of the terminal holding portion to thereby be hung by the terminal holding portion; and lock salients formed on the U-shape bent inner bottom surface of the short-circuit bridge portion so as to project therefrom to be able to lock the abutting end portion in a predetermined position.

In the above short-circuit terminal assembly, preferably, terminal removal holes and a terminal fitting hole are formed in the substantially closed end surface of the body portion of the housing.

In the short-circuit terminal assembly according to the present invention in which a U-shaped short-circuit terminal is fitted into a housing, the housing includes a box portion having its one end surface substantially closed and its other end surface opened as an open portion, and further includes a terminal holding portion which projects from the substantially closed end surface toward the opposite end surface so as to halve the hollow inside of the box portion. A, the U-shaped short-circuit terminal includes a short-circuit bridge portion substantially bent into a U-shape in vertical section. Two pairs of elastic socket portions are formed on outsides of opposite leg portions of the bridge portion by curving a pair of projection pieces toward each other on opposite sides of each of the leg portions so as to form the elastic socket portions. Accordingly, the U-shaped short-circuit terminal is inserted into respective hollow inner potions of the housing from the open portion of the housing and fitted to the terminal holding portion, thereby completing the desired preparation of circuit closing.

Further, the terminal holding portion of the housing includes lock projections provided on the terminal holding portion at its outer surfaces respectively near the one end surface so as to project for hanging and holding the short-circuit bridge portion, and an abutting end portion formed to have a shape substantially coincident with a U-shape bent inner bottom surface of the short-circuit bridge portion. The short-circuit bridge portion of the U-shaped short-circuit terminal includes lance portions formed in a manner so that respective end portions of leg portions of the short-circuit bridge portion near the substantially closed end surface are bent outward, engagement holes formed in the leg portions near the lance portions respectively so as to be engageable with the terminal holding portion to thereby be hung by the terminal holding portion, and lock salients formed on the U-shape bent inner bottom surface of the short-circuit bridge portion so as to project therefrom to be able to lock the abutting end portion in a predetermined position. Accordingly, the fitting of the U-shaped short-circuit terminal to the terminal holding portion and the hanging of the U-shaped short-circuit terminal by the terminal holding portion are stabilized more greatly, so that displacement hardly occurs in the U-shape bent portion of the short-circuit bridge portion near the tabs and in the elastic socket portions.

Furthermore, in the short-circuit terminal assembly according to the present invention, because terminal removal holes and a terminal fitting hole are formed in the substantially closed end surface of the box portion of the housing, the operation of attachment/removal of the U-shaped short-circuit terminal into/from the housing is carried out more rapidly.

BRIEF DESCRIPTION OF THE INVENTION

DETAILED DESCRIPTION OF THE INVENTION

A preferred embodiment of the short-circuit terminal assembly according to the preset invention will be described below in detail with reference to the accompanying drawings.

Figure 1:
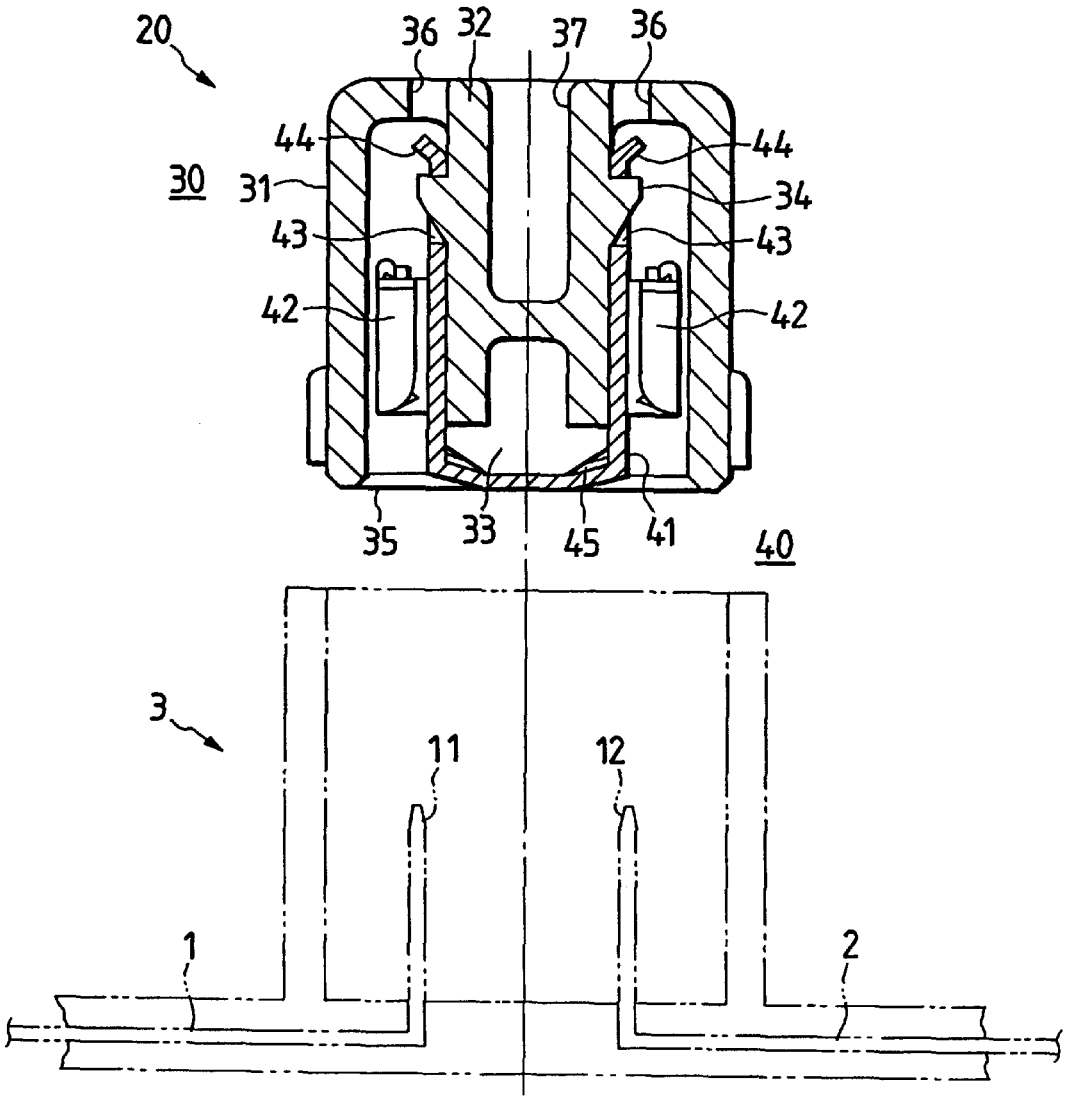
FIG. 1 is a vertical sectional view of a short-circuit terminal assembly according to the present invention.
Figure 2:
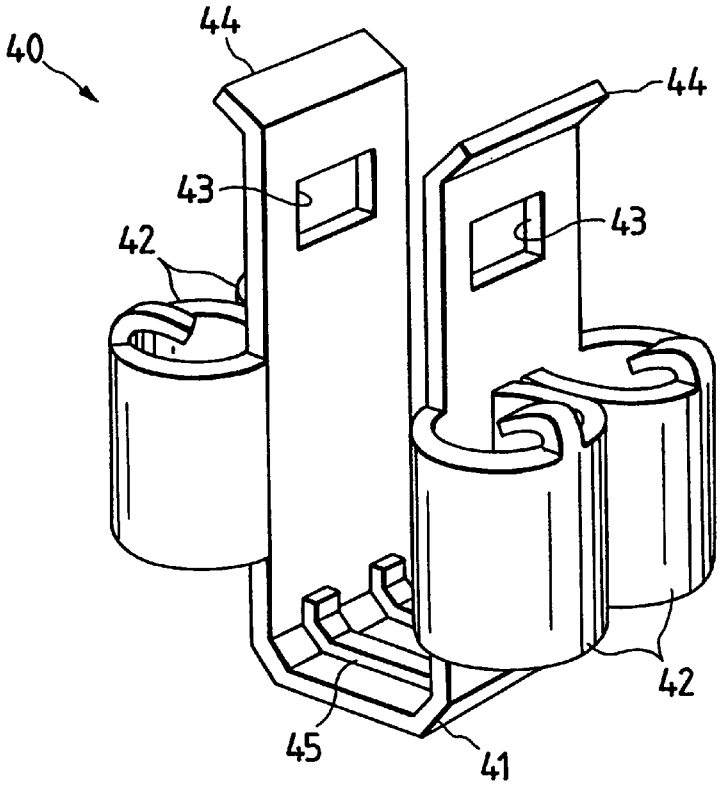
FIG. 2 is a perspective view of a U-shaped short-circuit terminal constituting the short-circuit terminal assembly according to the present invention.
Figure 3:
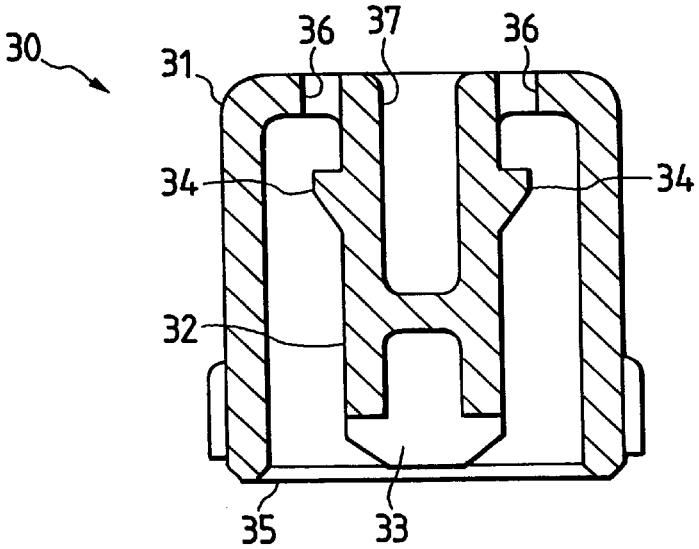
FIG. 3 is a vertical sectional view of a housing constituting the short-circuit terminal assembly according to the present invention.
Figure 4:
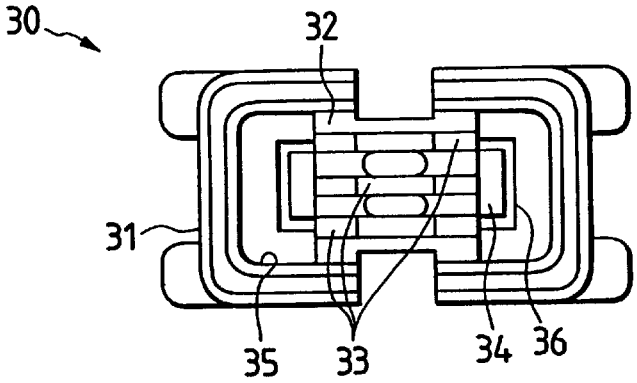
FIG. 4 is a plan view of the housing seen from an open portion of the housing in FIG. 3.
Figure 5:
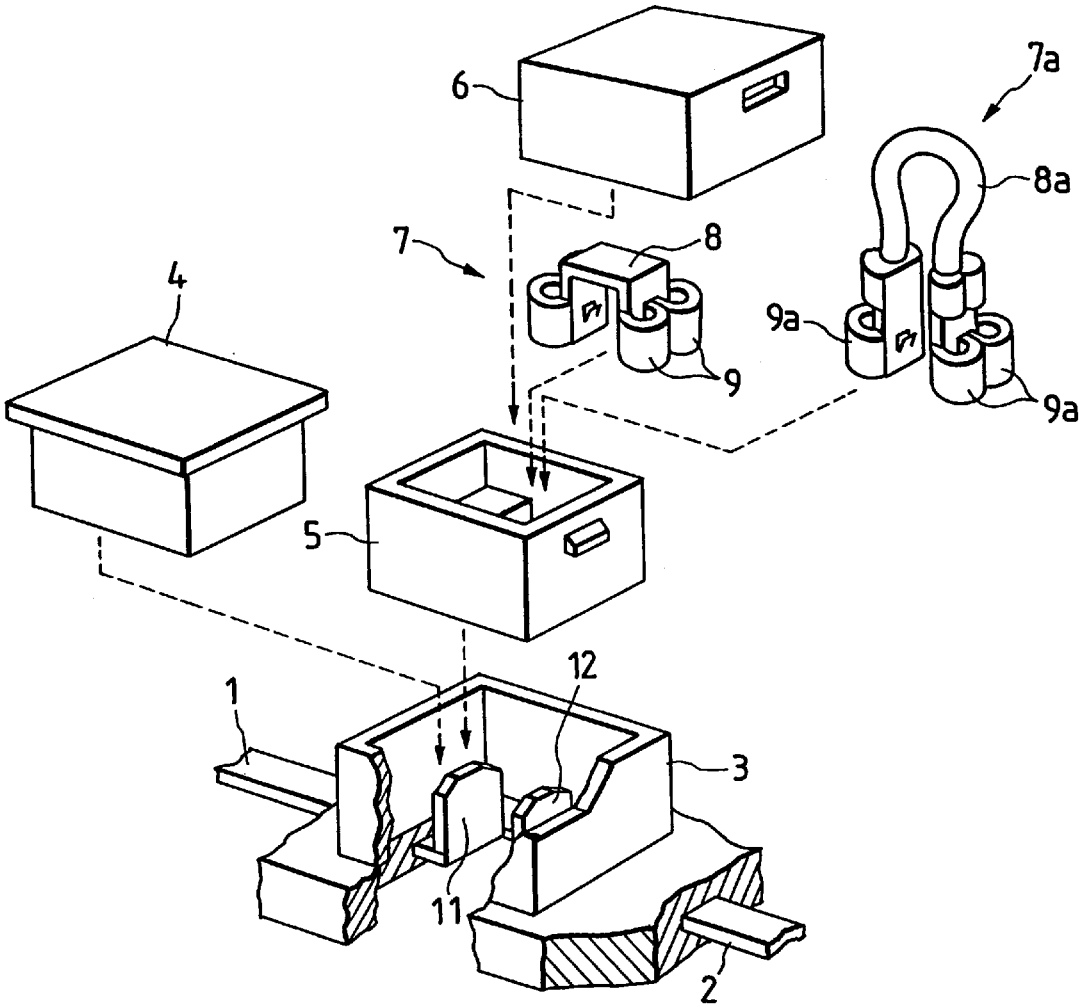
FIG. 5 PRIOR ART
FIG. 5 is a partly cutaway perspective view of a conventional short-circuit terminal assembly showing respective parts.
Figure 6:
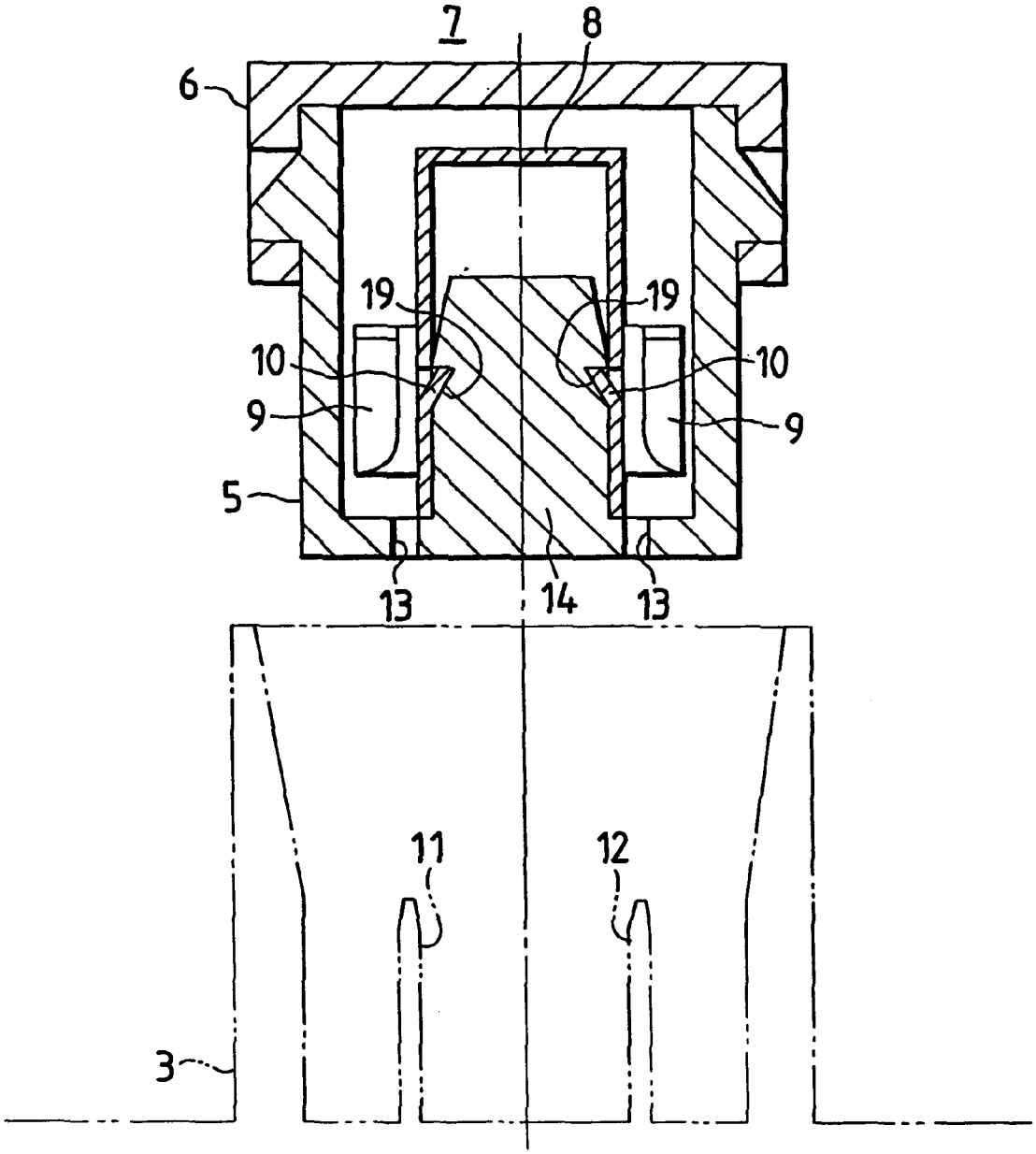
FIG. 6 PRIOR ART
FIG. 6 is a sectional view of the conventional short-circuit terminal assembly used in FIG. 5.

FIG. 1 is a vertical sectional view of a short-circuit terminal assembly 20 according to the present invention, FIG. 2 is a perspective view of a U-shaped short-circuit terminal 40 constituting the short-circuit terminal assembly 20 according to the present invention, FIG. 3 is a vertical sectional view of a housing 30, a component of the short-circuit terminal assembly 20 according to the present invention, and FIG. 4 is a plan view of the housing 30 seen from the open portion 35 of the housing 30 in FIG. 3.

The structure of the short-circuit terminal assembly 20 according to the present invention is roughly divided into a housing 30 and a U-shaped short-circuit terminal 40 fitted into the housing 30.

The housing 30 includes a box portion 31 having its one end surface substantially closed and its other end surface opened as an open portion 35, and further includes a terminal holding portion 32 which projects from the one end surface toward the opposite end surface so as to halve the hollow inside of the box portion 31. The U-shaped short-circuit terminal 40 includes a short-circuit bridge portion 41 substantially bent into a U-shape in vertical section. Two pairs of female terminals, that is, so-called elastic socket portions 42 are formed on outsides of opposite leg portions of the bridge portion 41 by curving a pair of projection pieces toward each other on opposite sides of each of the leg portions so as of the elastic socket portions facing each other 42.

Accordingly, assembling of the short-circuit terminal assembly 20 is completed in such a simple way that the U-shaped short-circuit terminal 40 is inserted into respective hollow inner portions of the housing 30 from the open portion 35 of the housing 30 and fitted to the terminal holding portion 32.

Further, the terminal holding portion 32 of the housing 30 includes: lock projections 34 provided on the terminal holding portion 32 at its outer surfaces respectively near the substantially closed end surface so as to project for hanging and holding the short-circuit bridge portion 41; and an abutting end portion 33 formed to have a shape substantially coincident with a U-shape bent inner bottom surface of the short-circuit bridge portion 41. Further, the U-shaped short-circuit terminal 40 includes: lance portions 44 formed in a manner so that respective end portions of leg portions of the short-circuit bridge portion 41 near the substantially closed end surface are bent outward; engagement holes 43 formed in the leg portions near the lance portions 44 respectively so as to be engageable with the lock projections of the terminal holding portion 32 to thereby be hung by the terminal holding portion 32; and lock salients 45 formed on the U-shape bent inner bottom surface of the short-circuit bridge portion 41 so as to project therefrom to be able to lock the abutting end portion 33 in a predetermined position.

Accordingly, the fitting of the U-shaped short-circuit terminal 40 to the terminal holding portion 32 and the hanging of the U-shaped short-circuit terminal 40 by the terminal holding portion 32 are stabilized more greatly by the function of fitting the engagement holes 43 to the lock projections 34 and the function of fitting the abutting end portion 33 to the lock salient portion 45. Accordingly, the U-shape bent portions of the short-circuit bridge portion 41 near the tabs 11 and 12 and the elastic socket portions 42 are hardly displaced.

Further, even in the case where deformation is caused by external force so that the distance between the lance portions 44 is widened, the deformation does not extend to the vicinity of the U-shaped bent portion of the short-circuit bridge portion 41 near the tabs 11 and 12 so that there is no occurrence of displacement having bad influence on the connection of the tabs 11 and 12 to the elastic socket portions 42.

Further, terminal removal holes 36 are formed in the substantially closed end surface of the box portion 31 of the housing 30 so that the lance portions 44 can be accessed through the terminal removal holes 36 by a suitable jig, and a terminal fitting hole 37 is formed also in the substantially end surface of the box portion 31 of the housing 30 so that a part of the terminal holding portion 32 can be pressed through the terminal fitting hole 37 by a suitable jig. Accordingly, the operation of attachment/removal of the U-shaped short-circuit terminal 40 into/from the housing 30 is carried out more rapidly.

The aforementioned short-circuit terminal assembly 20 according to the present invention has novel effects as follows.

That is, in the short-circuit terminal assembly 20 according to the present invention, the housing 30 includes the box portion 31 having one end surface substantially closed and the opposite end surface opened as the open portion 35, and further includes the terminal holding portion 32 which projects from the end surface substantially closed toward the opposite end surface so as to halve the hollow inside of the box portion 31. The U-shaped short-circuit terminal 40 includes the short-circuit bridge portion 41 substantially bent into a U shape in vertical section. Two pairs of elastic socket portions 42 are formed on outsides of opposite leg portions of the bridge portion 41 by curving a pair of projection pieces toward each other on opposite sides of each of the leg portions so as to form the elastic socket portions 42. Accordingly, it is possible to reduce the cost while the number of the whole parts of the short-circuit terminal assembly 20 is made small.

Further, the U-shaped short-circuit terminal 40 is inserted into the respective hollow inner portions of the housing 30 from the open portion 35 of the housing 30 and fitted to the terminal holding portion 32, so that preparation for closing a required circuit can be completed rapidly.

Further, in the short-circuit terminal assembly 20 according to the present invention, the terminal holding portion 32 of the housing 30 includes: the lock projections 34 provided on the terminal holding portion 32 at its outer surfaces respectively near the substantially closed end surface so as to project for hanging and holding the short-circuit bridge portion 41; and the abutting end portion 33 formed to have a shape substantially coincident with a U-shape bent inner bottom surface of the short-circuit bridge portion 41. Further, the short-circuit bridge portion 41 of the U-shaped short-circuit terminal 40 includes the lance portions 44 formed in a manner so that respective end portions of leg portions of the short-circuit bridge portion 41 near the substantially closed end surface are bent outward; the engagement holes 43 formed in the leg portions near the lance portions 44 respectively so as to be engageable with the lock projections 34 of the terminal holding portion 32 to thereby be hung by the terminal holding portion 32; and the lock salients 45 formed on the U-shape bent inner bottom surface of the short-circuit bridge portion 41 so as to project therefrom to be able to lock the abutting end portion 33 in a predetermined position. Accordingly, the fitting of the U-shaped short-circuit terminal 40 to the terminal holding portion 32 and the hanging of the U-shaped short-circuit terminal 40 by the terminal holding portion 32 are stabilized more greatly, so that the U-shape bent portion of the short-circuit bridge portion 41 near the tabs 11 and 12 and the elastic socket portions 42 can be prevented from being displaced.

Furthermore, in the short-circuit terminal assembly 20 according to the present invention, because the terminal removal holes 36 and the terminal fitting hole 37 are formed in the substantially closed end surface of the box portion 31 of the housing 30, the operation of attachment/removal of the U-shaped short-circuit terminal 40 into/from the housing 30 can be carried out more rapidly.

What is claimed is:

1. A short-circuit terminal assembly comprising:

a housing including one end surface substantially closed and an opposite end surface opened as an open portion, and further including a terminal holding portion projecting from said end surface substantially closed toward said open portion;

a U-shaped short-circuit terminal including a short-circuit bridge portion bent into a rough U-shape in vertical section so as to have an inner bottom, opposite leg portions, and elastic socket portions disposed on outsides of said opposite leg portions, said socket portions being made of projection pieces of each of said leg portions curved toward each other;

wherein said U-shaped short-circuit terminal is inserted into said housing from said open portion of said housing and fitted on to said terminal holding portion;

wherein when a tab is inserted into said short-circuit terminal assembly through said open portion, an insertion force causes said inner bottom of the U-shaped short-circuit terminal to be pushed against the terminal holding portion.

2. A short-circuit terminal assembly according to claim 1, wherein said terminal holding portion includes:

lock projections provided on outer surfaces of said terminal holding portion as to project for hanging and holding said U-shaped short-circuit terminal; and engagement holes disposed in said opposite leg portions so as to be engageable with said lock projections.

3. A short-circuit terminal assembly according to claim 1, wherein said U-shaped short-circuit terminal includes:

lance portions comprising outwardly bent end portions of said opposite leg portions near said end surface substantially closed.

4. A short-circuit terminal assembly according to claim 1, wherein said U-shaped short-circuit terminal includes:

engagement holes disposed in said opposite leg portions.

5. A short-circuit terminal assembly according to claim 1, wherein said end surface substantially closed of said housing is provided with terminal removal holes and a terminal fitting hole.

6. A short-circuit terminal assembly according to claim 1, wherein:

said terminal holding portion includes an abutting end portion having a shape substantially coincident with said inner bottom surface of said U-shaped short-circuit terminal;

lock salients are formed on said inner bottom of said U-shaped short-circuit terminal so as to project therefrom to be able to lock with said terminal holding portion.

7. A short-circuit terminal assembly according to claim 3, wherein said end surface substantially closed of said housing is provided with terminal removal holes.

8. A short-circuit terminal assembly according to claim 1, wherein said end surface substantially closed of said housing is provided with a terminal fitting hole.

9. A short-circuit terminal assembly comprising:

a housing including one end surface substantially closed and an opposite end surface opened as an open portion, and further including a terminal holding portion projecting from said end surface substantially closed toward said open portion;

a U-shaped short-circuit terminal including a short-circuit bridge portion bent into a rough U-shape in vertical section so as to have an inner bottom, opposite leg portions, and elastic socket portions disposed on outsides of said opposite leg portions, said socket portions being made of projection pieces of each of said leg portions curved toward each other;

wherein said U-shaped short-circuit terminal is inserted into said housing from said open portion of said housing and fitted to said terminal holding portion with said leg portions extending in an insertion direction;

wherein a mating connecting portion, having a pair of tabs which are respectively engageable into said housing with said elastic socket portions, is insertable from said open portion in said insertion direction.

* * * * *